US006427600B2

(12) United States Patent
Saxby

(10) Patent No.: US 6,427,600 B2
(45) Date of Patent: Aug. 6, 2002

(54) BLANK CARTRIDGE FOR SELF LOADING GUNS

(76) Inventor: Michael Ernest Saxby, 82 Cowdray Park Road, Little Common, Bexhill-on-Sea, East Sussex TN39 4EZ (GB)

( * ) Notice: Subject to any disclaimer, the term of this patent is extended or adjusted under 35 U.S.C. 154(b) by 0 days.

(21) Appl. No.: 09/848,151

(22) Filed: May 3, 2001

Related U.S. Application Data

(63) Continuation of application No. 09/220,640, filed on Dec. 24, 1998, now abandoned.

(30) Foreign Application Priority Data

Sep. 14, 1998 (GB) ..... 9819928

(51) Int. Cl.[7] ..... F42B 8/00

(52) U.S. Cl. ..... 102/444; 102/529; 102/447; 102/446; 102/498

(58) Field of Search ..... 102/444, 529, 102/430, 530, 447, 440, 446, 469, 464, 498; 89/14.5; 124/57, 71

(56) References Cited

U.S. PATENT DOCUMENTS

| | | | | |
|---|---|---|---|---|
| 387,256 | A | 8/1888 | Pratt | 222/3 |
| 3,477,375 | A | 11/1969 | Barr | 102/45 |
| 3,528,662 | A | 9/1970 | Merchant et al. | 273/106.5 |
| 3,782,286 | A | 1/1974 | Jones et al. | 102/41 |
| 3,837,284 | A | 9/1974 | Waldeisen | 102/92 |
| 3,952,662 | A | 4/1976 | Greenlees | 102/92.7 |
| 4,128,059 | A | 12/1978 | Black | 102/92.7 |
| 4,204,474 | A | 5/1980 | Mizelle | 102/92.7 |
| 4,531,458 | A | 7/1985 | Saxby | 102/440 |
| 4,539,969 | A | 9/1985 | Saxby | 124/57 |
| 4,637,616 | A | 1/1987 | Whiting | 273/418 |
| 4,686,905 | A | 8/1987 | Szabo | 102/444 |
| 4,697,523 | A | 10/1987 | Saxby | 102/440 |
| 4,823,702 | A | 4/1989 | Woolsey | 102/502 |
| 5,187,323 | A | 2/1993 | Saxby | 102/440 |
| 5,359,937 | A | 11/1994 | Dittrich | 102/430 |
| 5,438,907 | A | 8/1995 | Reynolds | 89/14.5 |
| 5,586,545 | A | 12/1996 | McCaslin | 124/73 |
| 5,700,972 | A | 12/1997 | Saxby | 102/440 |
| 5,706,795 | A | 1/1998 | Gerwig | 124/71 |

FOREIGN PATENT DOCUMENTS

| | | |
|---|---|---|
| GB | 1263522 | 2/1972 |
| GB | 1309362 | 3/1973 |
| GB | 1371482 | 10/1974 |
| GB | 2284252 A | 5/1995 |
| WO | WO 91/14916 | 10/1991 |
| WO | WO 95/05573 | 2/1995 |

*Primary Examiner*—Peter M. Poon
*Assistant Examiner*—F. Chad Copier
(74) *Attorney, Agent, or Firm*—Lahive & Cockfield, LLP

(57) ABSTRACT

The invention provides a blank pyrotechnic cartridge comprising a cartridge casing having a bullet-like projection extending forwardly therefrom, the bullet-like projection being retractable through an opening in the casing when the cartridge is fired, the cartridge being axially expandable in a rearwards direction in use to move the breechblock of a firearm to recycle the firearm.

Also provided is a method of feeding blank ammunition into the barrel of a gun comprising the step of loading the gun with a blank cartridge, the blank cartridge comprising a cartridge casing having a bullet-like projection extending forwardly therefrom, the bullet-like projection being retractable through an opening in the casing when the cartridge is fired, the cartridge being axially expandable in a rearwards direction in use to move a breechblock of the gun to recycle the gun.

18 Claims, 2 Drawing Sheets

BLANK CARTRIDGE FOR SELF LOADING GUNS

This application is a continuation application of Ser. No. 09/220,640 filed on Dec. 24, 1998, now abandoned. The contents of all of the aforementioned application(s) are hereby incorporated by reference.

BACKGROUND OF THE INVENTION

The present invention relates to blank cartridges, particularly those used for training in conjunction with simulators and war games. More especially, the invention relates to a blank cartridge that will cycle most known types of self loading small calibre guns without the use of external adapters or the release of toxic gases and debris.

The object of a blank cartridge is to cycle self loading guns, preferably without allowing any dangerous particles or emissions to leave the barrel of the gun.

However, presently, all known blank cartridges suffer several disadvantages. Firstly, without the benefit of a bullet sited at the front of the cartridge, the blank cartridge often feeds through and jams the internal mechanics of the gun.

Furthermore, to develop the back pressures required to operate the gun's reloading mechanism, special blank firing adapters are usually required. These adapters spoil the balance and handling of a gun.

It is also known that conventional blank cartridges emit toxic gases and debris from the barrel of the gun after firing, are limited in power and therefore are only suitable for a small number of gun types and calibres.

SUMMARY OF THE INVENTION

It is an object of the present invention to solve the aforementioned problems by providing a blank cartridge that will cycle most known types of self loading small calibre gun without the use of external adapters.

Accordingly, in a first aspect, the invention provides a blank pyrotechnic cartridge for use in a firearm, the cartridge comprising a cartridge casing having a bullet-like projection extending forwardly therefrom, the bullet-like projection being retractable through an opening in the casing when the cartridge is fired, the cartridge being axially expandable in a rearwards direction in use to move the breechblock of a firearm to recycle the firearm, the cartridge optionally having sealing means for preventing propellant gases from escaping through the opening upon firing.

In another aspect, the invention provides a blank cartridge (e.g. a pyrotechnic cartridge) comprising a cartridge casing having a bullet-like projection extending forwardly therefrom, the bullet-like projection being retractable through an opening in the casing when the cartridge is fired, sealing means being provided for preventing propellant gases from escaping through the opening upon firing; the cartridge being axially expandable in a rearwards direction in use to move the breechblock of a firearm to recycle the firearm.

In the cartridges of the invention, the expandable cartridge casing can comprise a piston portion slidably received within a sleeve portion. For example, the cartridge casing can have a nose portion, the sleeve portion extending rearwardly of the nose portion. The bullet-like projection can be connected to or formed integrally with the piston portion and, in one embodiment, the piston has a hollow rear portion from which the bullet-like projection extends forwardly. The hollow rear portion can contain a pyrotechnic composition.

In one preferred embodiment, the invention provides a blank cartridge including a sleeve extending rearwardly from a nose portion, and a piston slidably disposed within the sleeve; the piston having at its forward end a spigot slidably received in a channel through the nose portion and extending forwardly of the nose portion, the piston having at its rearward end a chamber containing a pyrotechnic composition; an expansion chamber being provided within the sleeve between the piston and the nose portion, one or more gas channels being provided between the pyrotechnic composition in the piston and the expansion chamber; whereupon after ignition of the pyrotechnic composition, expanding gas passing through the one or more gas channels into the expansion chamber moves the piston rearwardly in the sleeve, the rearward movement of the piston causing the gun to recycle.

Preferably, the piston is hollow and one or more gas channels are provided between the hollow interior of the piston and the expansion chamber.

Accordingly, in a particularly preferred embodiment, the invention provides a blank cartridge including a sleeve extending rearwardly from a nose portion, and a hollow piston slidably disposed within the sleeve; the piston having a spigot slidably received in a channel through the nose portion and extending forwardly of the nose portion; an expansion chamber being provided within the sleeve between the hollow piston and the nose portion, one or more gas channels being provided between the hollow interior of the piston and the expansion chamber; whereupon after ignition, expanding gas passing into the expansion chamber moves the piston rearwardly in the sleeve, the rearward movement of the piston causing the gun to recycle.

The expansion chamber can be defined by a circumferentially disposed inner surface of the sleeve, a generally axially facing surface of the piston and a generally axially facing surface of the nose portion. The expansion chamber can be, for example, of generally annular configuration, surrounding an inner end of the spigot.

In one preferred embodiment, the spigot is sealed within the channel through the nose portion by sealing means, for example circumferential sealing means such as an 'O'-ring, sited in a circumferential recess around the spigot. This prevents or minimises the escape of gases and other emissions from the barrel of the gun after firing.

The spigot typically is of a length such that after ignition,, all or the greater part of its length is withdrawn into the nose portion as the cartridge is expanded. This can be achieved for example by connecting the spigot to that portion of the expanding cartridge casing which is thrown rearwardly upon ignition.

The maximum extent of expansion of the cartridge casing is chosen such that when fully expanded, the cartridge can still be ejected from the gun in the normal way.

In yet another aspect, the invention provides a method of feeding blank ammunition into the barrel of a gun comprising the step of loading the gun with a blank cartridge as hereinbefore defined.

BRIEF DESCRIPTION OF THE DRAWINGS

An embodiment of the invention will now be described with reference to the following diagrammatic drawings in which.

DESCRIPTION OF THE PREFERRED EMBODIMENTS

Figure 1:
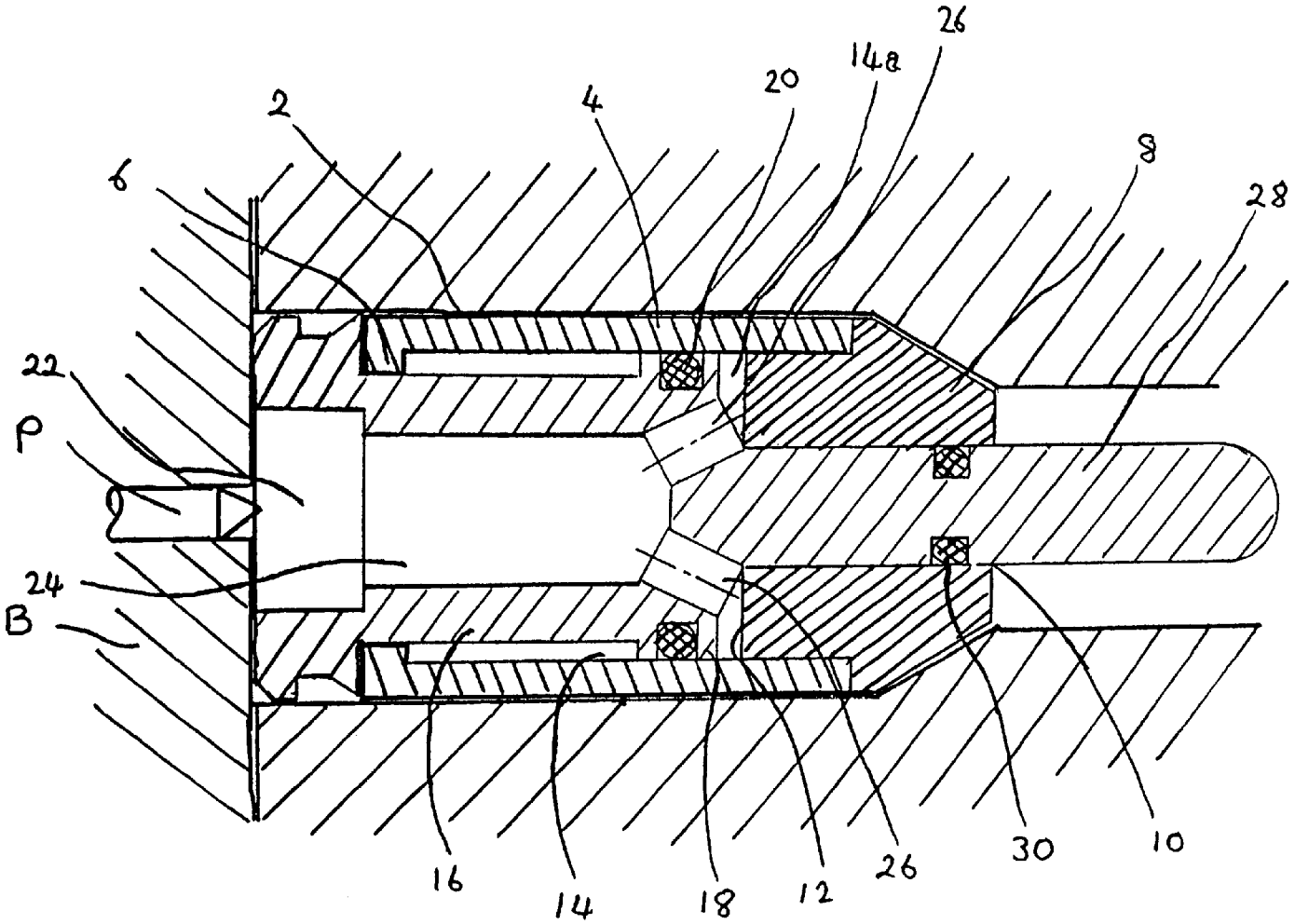
FIG. 1 is a longitudinal section through a blank gun cartridge, prior to firing, according to one embodiment of the invention.

A blank gun cartridge 2 according to the present invention is illustrated in FIG. 1. The cartridge 2 comprises a cylindrical cartridge casing 4 with an in-turned flange 6 at the rearward end. The forward end of the casing comprises a nose portion 8, which in this embodiment is in the form of a plug, from which cylindrical cartridge casing 4 extends in a rearwards direction. The plug has an axial bore 10.

The inner surface of the sleeve and the rearward surfaces 12 of the plug define a piston chamber 14. A piston 16 is slidably contained within the piston chamber 14 and has a pair of outwardly extending flanges 18 at its forward end. Nested between the flanges 18 and surrounding the piston is an 'O'-ring 20 to provide a seal between the forward end of the piston and the inner surface of the casing.

A pyrotechnic composition 22 is housed at the rearward end of the piston 16. Extending from the pyrotechnic composition to the forward end of the piston is a first gas expansion chamber 24. At the head of the gas expansion chamber 24, gas channels 26 allow the flow of propellant gas from the first expansion chamber 24 into a second expansion chamber 14*a* (which corresponds to the expansion chamber defined in the claims appended hereto), which is defined by the space between the piston head and the rearward surface 12 of the plug.

A spigot 28 extends from the forward end of the piston and is slidably contained within the axial bore 10 of the plug. Spigot 28 is surrounded by O-ring 30 which provides a seal with the inner surface of the axial bore 10.

In operation, the pyrotechnic composition 22 is activated by the impact of the firing pin P and the propellant gas formed by ignition of the composition expands into the first gas expansion chamber 14 and then through the gas channels 26 between the first gas expansion chamber 14 and the second expansion chamber 14*a* at the front of the piston. The pressure of expanding gas in the second expansion chamber forces the piston (and with it the spigot) to move rearwardly relative to the outer casing 4. Thus the piston is propelled rearwardly against the breech block B to recycle the firearm.

Figure 2:
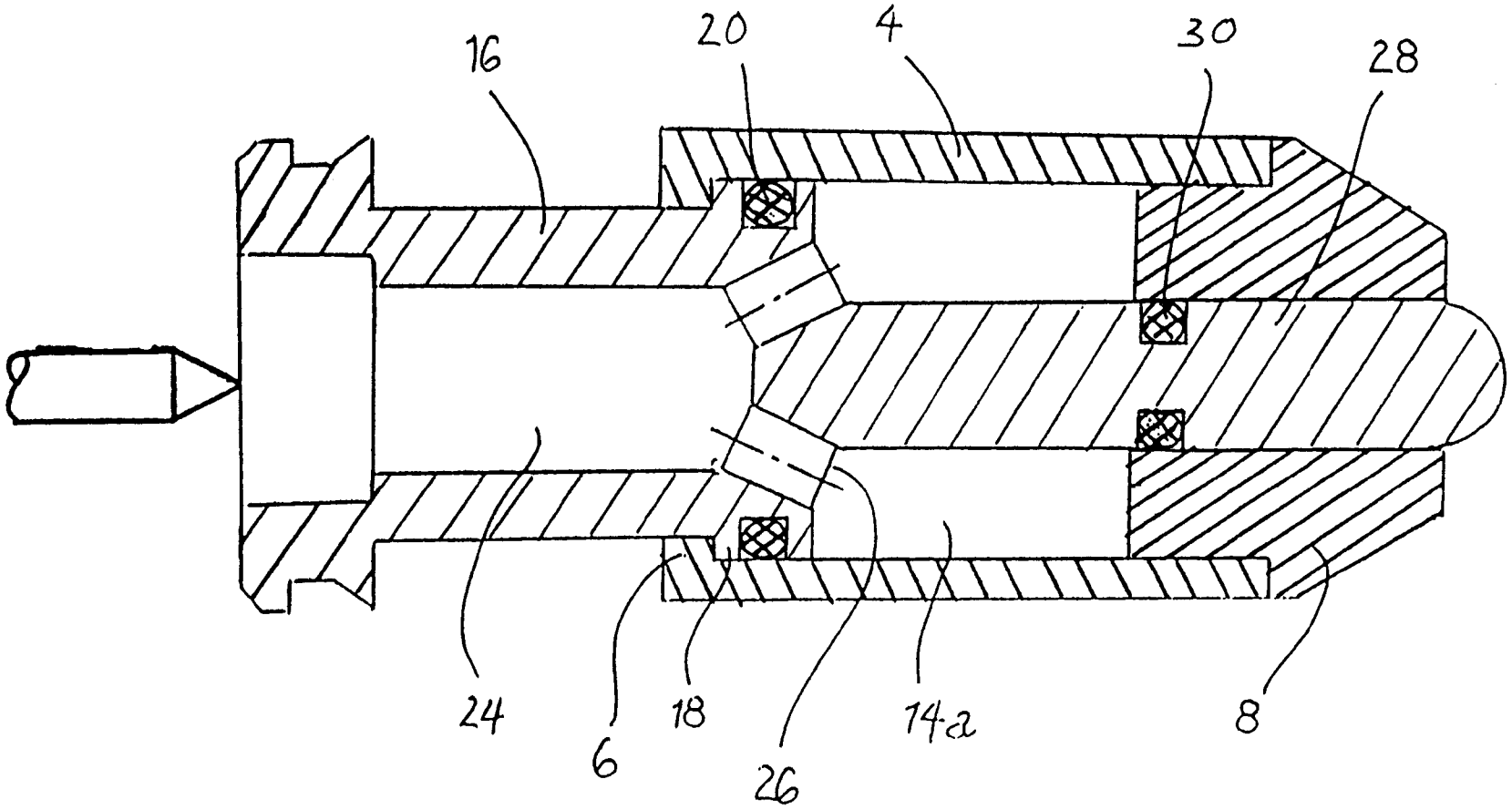
FIG. 2 is a longitudinal section through the gun cartridge shown in FIG. 1 after the blank cartridge has recycled.

The extent of rearwards movement of the piston, and hence the degree of expansion of the cartridge casing is limited by the flanges 18 on the forward end of the piston which engages with the flange 6 on the rearward end of the cylindrical cartridge casing 4 (FIG. 2).

As the cartridge casing expands and the piston 16 is propelled rearwardly, the bullet shape presented by the spigot is withdrawn into the cartridge keeping the overall length of the cartridge substantially the same as a normal spent cartridge and thereby allowing the cartridge to be ejected in the normal way.

As can be seen from FIGS. 1 and 2, at least a portion of the spigot 28 remains in the bore 10 after firing. An advantage of this is that it prevents relative pivoting movement taking place between the piston and the casing as the piston moves rearwardly out of the casing, eliminating the risk of the base section of the piston bending relative to the axis of the assembly and missing the cartridge eject mechanism of the gun.

One advantage of the blank cartridge of the present invention is that the presence of an 'O'-ring seal 30 on the spigot prevents any gas escaping from the cartridge in cases where zero emissions are required. A further advantage, which arises from the presence of the bullet-like projection, is that the cartridge feeds from the magazine into the firing chamber much more easily and with considerably reduced likelihood of jamming.

It is to be understood that the foregoing is merely exemplary of one embodiment of the invention and that modifications can be made thereto without departing from the scope of the invention.

What is claimed is:

1. A blank pyrotechnic cartridge comprising a cartridge casing having a bullet-like shape projection extending forwardly therefrom, the bullet-like shape projection being retractable into the cartridge through an opening in the casing when the cartridge is fired, the cartridge being axially expandable in a rearwards direction in use to move the breechblock of a firearm to recycle the firearm.

2. A blank cartridge according to claim 1 wherein sealing means are provided for preventing propellant gases from escaping through the opening upon firing.

3. A blank cartridge according to claim 1 wherein the expandable cartridge casing comprises a piston portion slidably received within a sleeve portion.

4. A blank cartridge according to claim 3 wherein the cartridge casing has a nose portion and the sleeve portion extends rearwardly of the nose portion.

5. A blank cartridge according to claim 4 wherein the bullet-like shape projection is connected to or formed integrally with the piston portion.

6. A blank cartridge according to claim 4 wherein the piston has a hollow rear portion from which the bullet-like shape projection extends forwardly.

7. A blank cartridge according to claim 6 wherein the hollow rear portion contains a pyrotechnic composition.

8. A blank cartridge according to claim 7 wherein the hollow rear portion defines a first expansion chamber, and a second expansion chamber is defined by inner surfaces of the nose portion and sleeve, and a leading surface of the hollow rear portion, one or more gas channels being provided between the first and second expansion chambers.

9. A blank cartridge including a sleeve extending rearwardly from a nose portion, and a piston slidably disposed within the sleeve; the piston having at its forward end a bullet-like shape spigot slidably received in a channel through the nose portion and extending forwardly of the nose portion, the piston having at its rearward end a chamber containing a pyrotechnic composition; an expansion chamber being provided within the sleeve between the piston and the nose portion, one or more gas channels being provided between the pyrotechnic composition in the piston and the expansion chamber; whereupon after ignition of the pyrotechnic composition, expanding as passing through the one or more gas channels into the expansion chamber moves the piston rearwardly in the sleeve, the rearward movement of the piston causing a gun to recycle and the bullet-like shape spigot to retract into the nose portion.

10. A blank cartridge according to claim 9 wherein the piston is hollow and said one or more gas channels are provided between the hollow interior of the piston and the expansion chamber.

11. A blank cartridge according to claim 9 wherein the expansion chamber is defined by a circumferentially disposed inner surface of the sleeve, a generally axially facing surface of the piston and a generally axially facing surface of the nose portion.

12. A blank cartridge according to claim 9 wherein the expansion chamber is of generally annular configuration, surrounding an inner end of the bullet-like shape spigot.

13. A blank cartridge including a sleeve extending rearwardly from a nose portion, and a hollow piston slidably disposed within the sleeve; the piston having a bullet-like shape spigot slidably received in a channel through the nose portion and extending forwardly of the nose portion; an expansion chamber being provided between the hollow interior of the piston and the expansion chamber; whereupon after ignition, expanding gas passing into the expansion chamber moves the piston rearwardly in the sleeve, the rearward movement of the piston causing a gun to recycle, and the bullet-like shape spigot to be retracted into the nose portion.

14. A blank cartridge according to claim 13 wherein the expansion chamber is of generally annular configuration, surrounding an inner end of the bullet-like shape spigot.

15. A blank cartridge according to claim 13 wherein the bullet-like shape spigot is sealed within the channel through the nose portion by sealing means sited in a circumferential recess around the spigot.

16. A blank cartridge according to claim 15 wherein the sealing means takes the form of a circumferential sealing means, for example, an 'O'-ring.

17. A blank cartridge according to claim 13 wherein the bullet-like shape spigot is of a length such that after ignition, the greater part of its length is withdrawn into the nose portion.

18. A combination of a firearm and a blank cartridge, the firearm having a firing chamber in which the blank cartridge is received, the cartridge being expandable upon ignition such that a portion thereof is propelled rearwardly against a breechblock at one end of the firing chamber to recycle the firearm, the cartridge having a bullet like shape projection extending forwardly therefrom, the bullet-like shape projection being retracted into the cartridge upon ignition; wherein the length of the cartridge after complete expansion thereof is limited such that the cartridge can be ejected from the chamber.

* * * * *